US006058198A

United States Patent [19]

Aceti et al.

[11] Patent Number: 6,058,198

[45] Date of Patent: May 2, 2000

[54] BATTERY AND CIRCUITRY ASSEMBLY

[75] Inventors: John G. Aceti, Cranbury, N.J.; Walter P. Sjursen, Washington Crossing, Pa.; Marvin A. Leedom, Princeton, N.J.

[73] Assignee: Sarnoff Corporation, Princeton, N.J.

[21] Appl. No.: 08/897,422

[22] Filed: Jul. 21, 1997

Related U.S. Application Data

[63] Continuation-in-part of application No. 08/641,591, May 1, 1996.

[60] Provisional application No. 60/014,245, Mar. 26, 1996.

[51] Int. Cl.[7] ..... H04R 25/00

[52] U.S. Cl. ..... 381/323; 381/322; 381/328; 429/7; 429/27

[58] Field of Search ..... 381/23.1, 322, 381/323, 324, 328, FOR 137, 327, 330; 324/432; 429/4, 7, 27, 82

[56] References Cited

U.S. PATENT DOCUMENTS

| | | | |
|---|---|---|---|
| 3,598,928 | 8/1971 | Hickox | 381/328 |
| 4,712,245 | 12/1987 | Lyregaard | 381/328 |
| 5,133,016 | 7/1992 | Clark | 381/328 |
| 5,185,802 | 2/1993 | Stanton | 381/68.6 |
| 5,550,474 | 8/1996 | Dahl | 324/432 |
| 5,572,594 | 11/1996 | Devoe et al. | 381/328 |

*Primary Examiner*—Huyen Le
*Attorney, Agent, or Firm*—William J. Burke

[57] ABSTRACT

A electronic circuit including an enclosed housing having an electronic circuit therein and an air-cathode/separator assembly having a catalyst layer and which is filled with an electrolyte/anode mixture which forms a battery for operating the electronic circuit. The device may also including a speaker and a microphone which are in the housing and connected to the electronic circuit to form a hearing aid.

20 Claims, 3 Drawing Sheets

BATTERY AND CIRCUITRY ASSEMBLY

CROSS-REFERENCE TO RELATED APPLICATIONS

This application is a continuation-in-part of U.S. application Ser. No. 08/641,591, filed on May 1, 1996, which claims the benefit of the filing date of U.S. provisional Application No. 60/014,245, filed on Mar. 26, 1996.

FIELD OF THE INVENTION

The present invention relates to an electronic circuit and battery assembly, and, more particularly, to a battery which is useful in a device, such as a hearing aid, and which is an integral part of the electronic circuitry for the device.

BACKGROUND OF THE INVENTION

Hearing aids generally use conventional zinc-air button batteries because of their inherent high-energy storage and convenience. The zinc-air battery is commercially available in several different sizes. All are pancake looking with the diameter several times the height. The smallest button battery is for the in-the-canal hearing aids. This form factor is not always suitable for the orientation needed in the ear so that this becomes increasingly important as hearing aids become smaller.

A zinc-air battery system consists of four basic elements, i.e., the anode, the cathode, the air cathode and the electrolyte. In a zinc-air system, the cathode is the oxygen in the air and the air cathode promotes the reaction of oxygen with the electrolyte. The electrolyte is a liquid, generally potassium hydroxide. The anode is generally a metal, such as zinc. Since zinc-air batteries are exposed to air for activation, the system's electrolyte is depleted by evaporation. While evaporation can be controlled to provide the limited life required, the battery must be sealed during storage. With traditional hearing aid batteries, a metal foil with pressure sensitive adhesive is applied over small holes in the battery so as to prevent the entry of air. When, the battery is to be used, the foil is removed allowing air to enter the battery and the reaction begins.

Hearing aids have been made smaller to provide for in-the-ear and completely in the canal hearing aids. The smaller the hearing aid the smaller the battery must be. Because of the small sizes of batteries being used in the hearing aids, it is difficult and frustrating to replace the batteries when the batteries run out. The small batteries are difficult to handle, especially for the elderly, who are the majority of the users of hearing aids.

To overcome the problem of the necessity of replacing batteries in a hearing aid, a disposable hearing aid has been developed. The disposable hearing aid is of a structure that is so inexpensive to manufacture that it is possible to merely replace the whole hearing aid, rather than just the battery, when the battery runs out. Thus, the life of a disposable hearing aid is dependent on the life of the battery. The longer the life of the battery, the less often the hearing aid has to be replaced and the less expensive it is to use the disposable hearing aid. Therefore, it would be desirable to have a battery for a disposable hearing aid that has a longer life.

SUMMARY OF THE INVENTION

The present invention is directed to an electronic circuit which includes an enclosed housing having an electronic circuit therein. The housing is filled with an electrolyte/anode solution. One end of the housing includes an air-cathode/separator assembly. An electrical contact is in the housing and in contact with the electrolyte/anode solution. Together the electrolyte/anode solution and air-cathode/separator assembly form a battery which is connected to and operates the electronic circuit.

The present invention is also directed to a hearing aid which includes an enclosed housing having opposite ends. A speaker is in the housing and extends through one end of the housing. A microphone is in the housing and extends through the other end of the housing. An electronic circuit is in the housing and is connected to the speaker and the microphone. The housing is filled with an electrolyte/anode solution and an air-cathode/separator assembly which forms a battery for operating the electronic circuit. Filling all the available space within the housing is significantly more volumetrically efficient than using conventional batteries and provides a hearing aid having comparatively longer life of operation.

BRIEF DESCRIPTION OF THE DRAWING

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
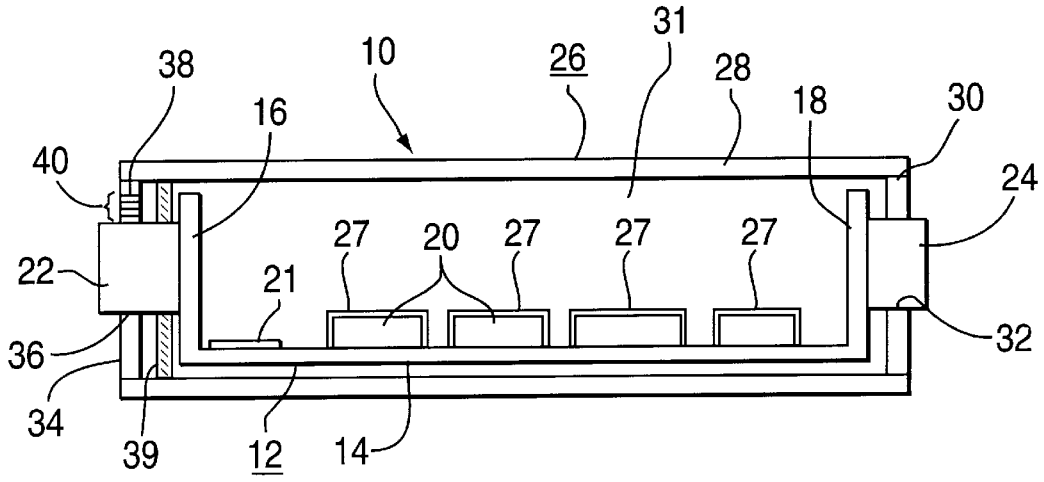
FIG. 1 is a sectional view of the electrical portion of one form of the hearing aid of the present invention.

Referring initially to FIG. 1, the electronic assembly portion of the hearing aid of the present invention is generally designated as 10. Assembly 10 comprises a flexible printed circuit 12 which includes a sheet of a flexible insulating material, such as a plastic, having a pattern of conductors on at least one surface thereof. As shown, the flexible printed circuit 12 is in the form of a U having a base 14 and upstanding arms 16 and 18 at the ends thereof. However, it should be understood that the flexible circuit 12 could be of any desired shape. Mounted on the flexible circuit 12 are various electronic devices 20, such as integrated circuits, resistors, capacitors, inductors, etc., which make up the electronic circuit for the hearing aid. The electronic devices 20 are electrically connected to the conductor pattern on the flexible circuit 12 so as to be electrically connected in the desired circuit. Also on the flexible circuit is a metal electrode 21. Mounted on the arm 16 of the flexible circuit 12 is a small microphone 22 and mounted on the arm 18 of the flexible circuit 12 is a small speaker 24.

The flexible circuit 12 with the electronic devices 20 thereon is within housing 26. Housing 26 is preferably constructed of an electrically insulating material which is not damaged by electrolyte 31. Urethanes are suitable for this purpose. The housing 26 includes an outer wall 28 and an end wall 30. The outer wall 28 is preferably cylindrical although it can be of any shape. The end wall 30 has an opening 32 therethrough through which the speaker 24 extends with a tight fit. A cap 34 extends across and is sealed to the other end of the outer wall 28. The cap 34 has an opening 36 through which the microphone 22 extends with a tight fit. The cap 34 also has a plurality of small holes 38 therethrough through which air can pass. A foil strip 40 having an adhesive on one surface is on the outer surface of the cap 34 and extends over the holes 38.

The housing 26 is filled, preferably to about 80–90% of its volume, with an anode/electrolyte mixture 31. The electrolyte may be potassium hydroxide or sodium hydroxide and allows electrical current to flow through the battery by movement of the hydroxide ions. The metallic anode material, typically zinc, reacts with the hydroxide ions to form a metallic-oxide (zinc oxide) and produce an electrical potential. The housing is not completely filled to allow for expansion of, for example, the zinc to zinc oxide. Since the electrolyte is a toxic, corrosive, caustic material, the electronic devices 20 and the conductors on the flexible circuit 12 are coated with a protective conformal coating 27 of a material which is not attacked by the electrolyte, such as a plastic or fluoropolymers such as Parylene®. The contact 21 may be protected from the electrolyte by a coating of a noble metal.

Figure 1A:
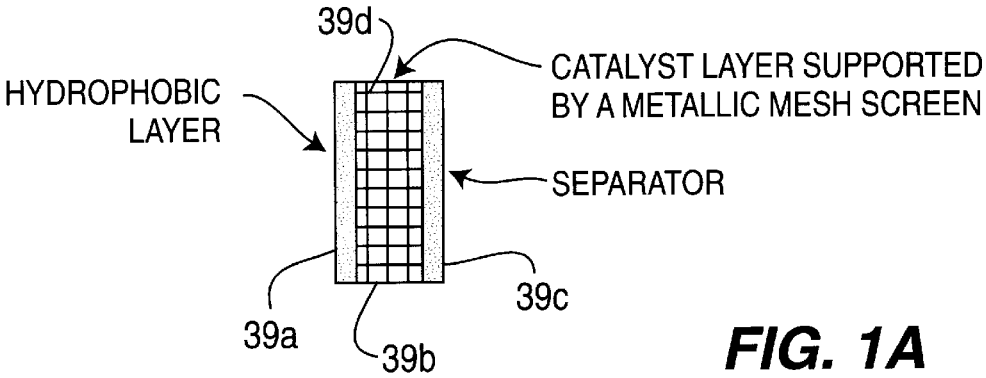
FIG. 1A is a detailed view of an air-cathode/separator assembly used in the hearing aid in FIG. 1.

Referring now also to FIG. 1A, air-cathode/separator assembly 39 typically consists of three layers: hydrophobic layer 39*a* (typically Teflon®), catalyst layer 39*b* supported by a metallic mesh screen 39*d*(typically nickel) and a separator 39*c*. Assembly 39 generally provides a reaction site, as explained further below, typically for oxygen and water to form peroxide and hydroxide. A second reaction then converts the peroxide into hydroxide and oxygen. The air-cathode material is commercially available from such companies as Alupower, Inc. of Pawcatuck, Conn.

Hydrophobic layer 39*a* allows oxygen to pass through to catalyst layer 39*b* but inhibits electrolyte from leaking out of housing 26. Catalyst layer 39*b* provides a reaction site for the cathode. The metallic screen 39*d* provides mechanical support for the catalyst layer 39*b* and provides a low impedance electrical connection for the cathode. The catalyst layer 39*b* typically consists of carbon with catalytic compounds. The catalysts promote the conversion reaction of peroxide into hydroxide and oxygen.

Separator 39*c* provides electrical separation between the metallic anode material(typically zinc)in electrolyte/anode solution 31 and the air-cathode assembly 39, yet allows the electrolyte, typically potassium hydroxide or sodium hydroxide to pass through.

Figure 2:
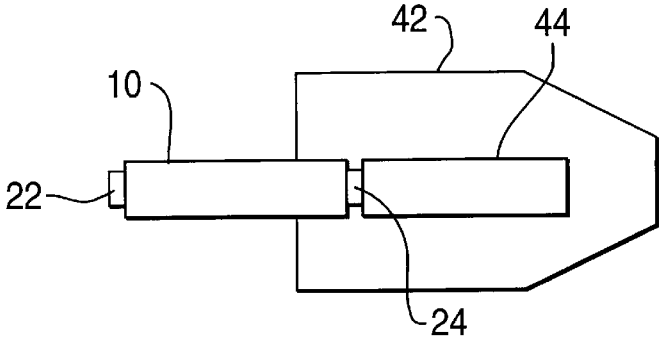
FIG. 2 is a schematic view of the entire hearing aid.

To use the assembly 10 in a hearing aid, the assembly 10 is mounted in an ear mold 42 as shown in FIG. 2. The ear mold 42 is preferably of a soft, durable and compliant material, such as a cold-cured methacrylate, heat-cured methacrylate, heat-cured silicone, polyvinyl chloride copolymer or polyethylene co-polymer. The ear mold 42 has an inner channel 44 into which the assembly 10 is inserted. The outer configuration of the ear mold 42, such as shape and size, is such that it can be readily inserted in the ear canal of the user and will conform to the shape of the ear canal. Since the ear mold 42 is of a compliant material, the pressure of the ear mold 42 against the wall of the ear canal produces a good fit needed to prevent acoustical feedback and to help retain the hearing aid in the ear.

Either just before or just after inserting the assembly into the ear mold 42, the foil strip 40 is removed to allow air to enter the housing 26 through the holes 38. The air entering the housing 26 reacts with the electrolyte, within catalyst layer 39*b*, to provide a flow of current. The current flows to the contact 21 so as to operate the circuit of the hearing aid. The electrical current path preferably is completed by an electrical connection between assembly 39 and the conductive casing of microphone 22. Compared to comparably sized conventional hearing aids, there is provided a greater amount of electrolyte/anode 31 and therefore a longer life for this assembly and hearing aid.

Figure 3:
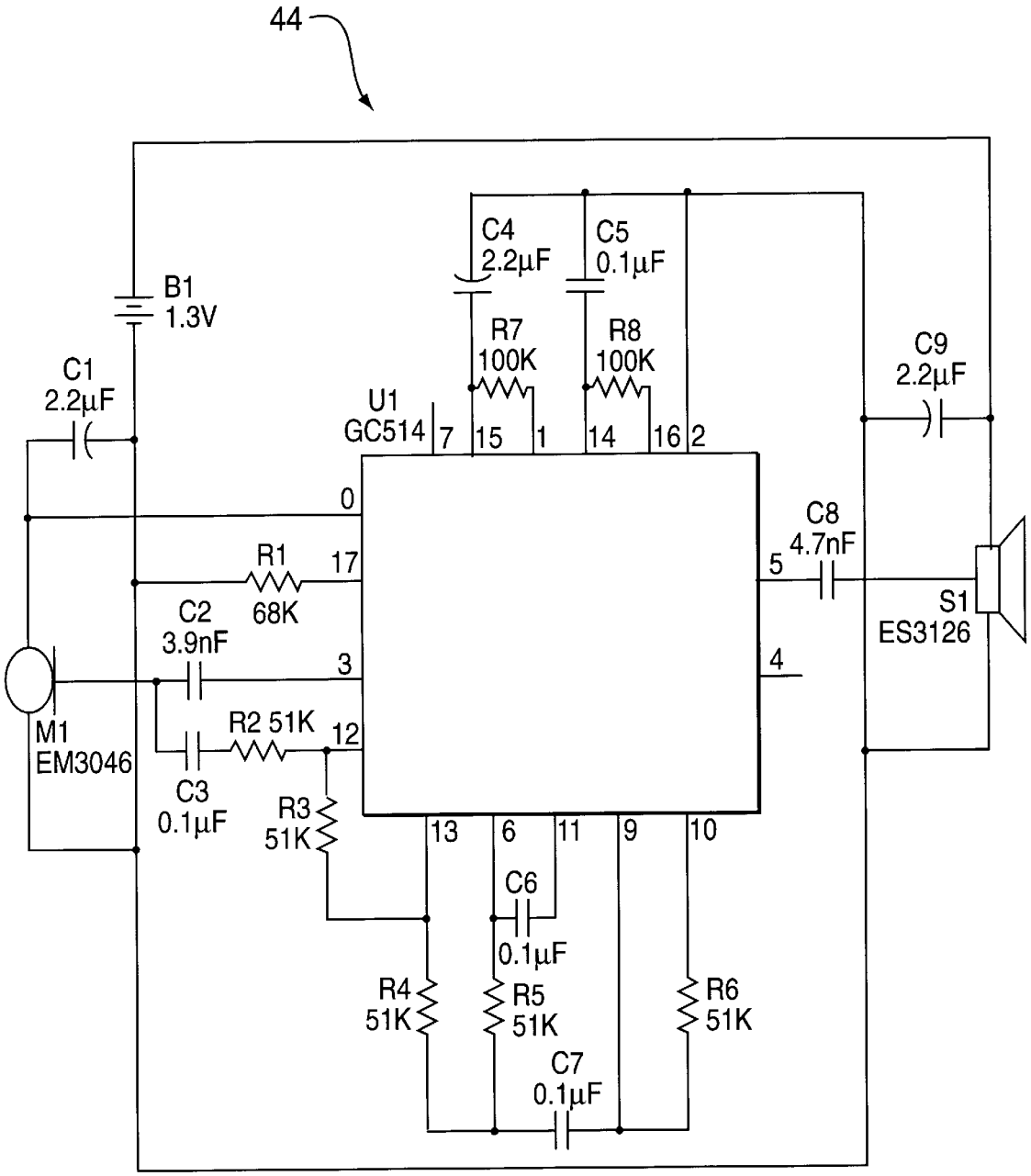
FIG. 3 is a schematic diagram of an electrical circuit for a hearing aid.

A schematic diagram of an electrical circuit 44 for a hearing aid is shown in FIG. 3. The main electrical components are a microphone M1 (a model EM3046 by Knowles Electronics, Chicago, Ill), a speaker S1 (a model ES3126 by Knowles Electronics), an integrated circuit U1 (a model GC514 from Gennum Corp., Toronto, Canada) and a 1.3 volt battery B1. The microphone M1 converts an acoustical signal into an electrical signal. This signal is amplified and processed by the integrated circuit U1. The output of the integrated circuit U1 drives the speaker S1. The speaker S1 converts the electrical signal back to an acoustical signal which vibrates the ear drum. The functions of other components of the electrical circuit 44 are as follows:

Capacitors C1 and C9 provide power supply decoupling;

Capacitor C3 and resistors R2 and R3 set gain and frequency response of low frequency channel;

Capacitor C2 sets corner frequency of high frequency channel;

Resistor R1 sets threshold of compression;

Capacitor C4 and resistor R7 set time constant of slow average detector;

Capacitor C5 and resistor R8 set time constant of fast average detector;

Capacitor C6 couples signal to rectifier circuit to detect signal level;

Resistors R4 and R5 and capacitor R7 sum low and high frequency channels;

Resistor R6 sets overall gain of circuit; and

Capacitor C8 couples integrated circuit output to the speaker S1.

Unless otherwise stated, all resistor values are in ohms and all capacitor values are in microfarads. Component values shown are typical only. Actual values depend on number of channels desired, gain and frequency response.

Figure 4:
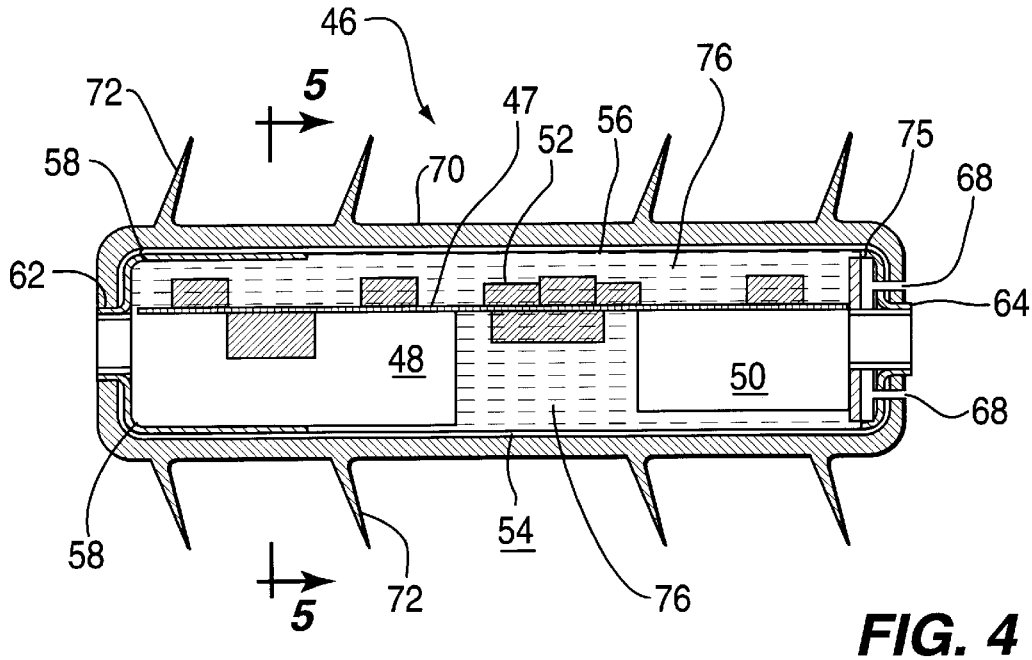
FIG. 4 is a sectional view of another form of the hearing aid of the present invention.
Figure 4A:
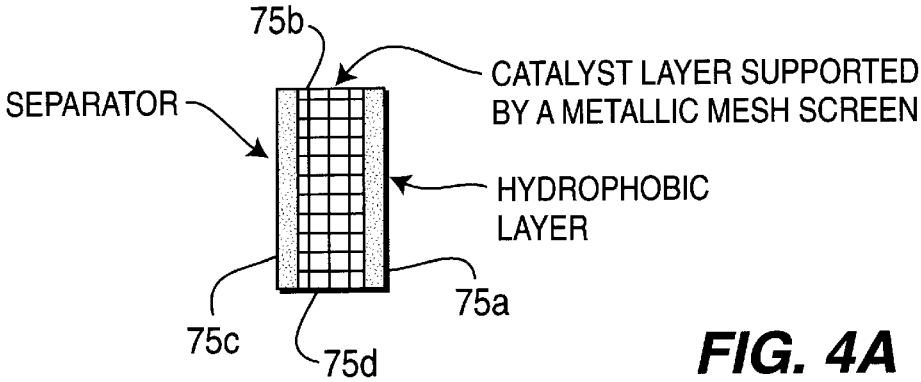
FIG. 4A is a detailed view of an air-cathode/separator assembly used in the hearing aid of FIG. 4.
Figure 5:
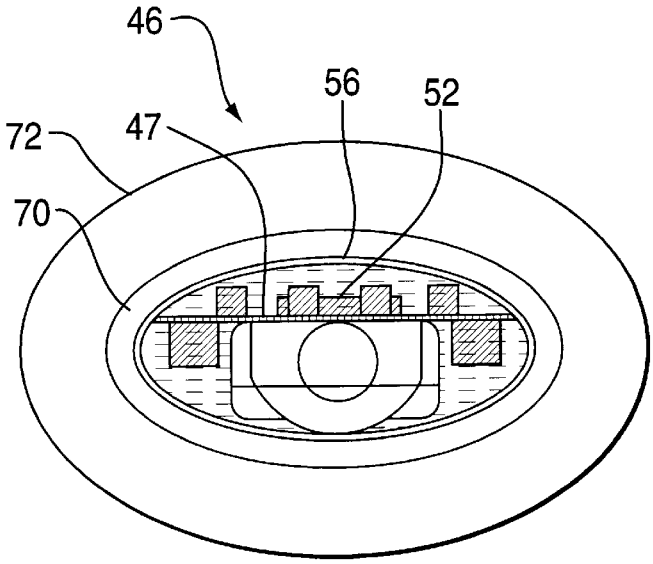
FIG. 5 is a sectional view taken along line 5—5 of FIG. 4.

Referring to FIGS. 4, 4A and 5, another form of the hearing aid of the present invention is generally designated as 46. Hearing aid 46 comprises a printed circuit board 47 having mounted thereon a speaker 48, a microphone 50 and various electronic devices 52 which form the electronic circuit of the hearing aid 46. The speaker 48 and microphone 50 are at opposite ends of the printed circuit board 47. The printed circuit board 47 is within a housing 54 which is formed of a tubular sleeve 56 and cup shaped end cap 58. As shown in FIG. 5, the tubular sleeve 56 and end cap 58 are preferably elliptical in cross-section so as to fit better in a user's ear. The end cap 58 is constructed of an electrically conductive material, such as a metal, a conductive polymer, or a metal coated polymer, and the sleeve 56 is of an insulating material, such as a plastic or urethane. The end cap 58 fits tightly in the ends of the sleeve 56 and is secured to the sleeve 56. The speaker 48 extends through and fits tightly in a hole 62 in the end cap 58 and ear mold 70, and the microphone 50 extends through and fits tightly in a hole 64 in ear mold 70. The end cap 58 being conductive serves as an electrode as explained further below.

The housing 54 is filled with an anode/electrolyte mixture 76. The electrolyte may be, for example, potassium hydroxide or sodium hydroxide. The anode is, for example, zinc. The ear mold 70 also has one or more holes 68, through which air can enter the housing 54 and react with the electrolyte in air-cathode/separator assembly 75, in the manner described above. As shown in FIG. 4A, assembly 75 has hydrophobic layer 75*a*, catalyst layer 75*b* (including metallic mesh screen 75*d*) and separator 75*c*. When the device is not in use, an adhesive strip (not shown) may be placed over the holes 68. The housing 54 is enclosed in an ear mold 70 of a soft, durable and compliant material. As shown, the ear mold 70 has substantially radially projecting wings 72 which help hold the hearing aid 46 in the user's ear.

In the use of the hearing aid 46, speaker 48 is electrically connected to the end caps 58. End cap 58 is made of a current carrying material. The frame of the speaker 48 also is constructed of a current carrying material. Current generated in, for example, electrolyte/anode solution 76 flows through end cap 58 to the metal housing of speaker 50 through circuit board 47 and the components thereon, to air-cathode/separator assembly 75 via the current-carrying case of microphone 50. An electrically insulating material, for example the flouropolymer Parylene®, preferably is used to protect all components exposed to electrolyte/anode solution 76. The sleeve 56 of the housing 54 is of a plastic so as to be flexible. This allows the housing 54 to bend so that it will fit a variety of internal ear canal shapes. The more flexible the hearing aid is, the more comfortable the hearing aid will be in the user's ear.

Thus, there is provided by the present invention an electronic assembly for a hearing aid which is small and compact but which contains the entire circuit for operating the hearing aid, including circuit components, microphone and speaker. The electronic assembly is small enough to be inserted in an ear mold for a hearing aid which can be inserted completely into the ear of a user. However, the assembly also includes an integral battery which substantially fills the housing of the assembly so as to provide a more volumetrically efficient battery having a longer life. Although the assembly's life is longer it does not add very much to the overall cost of the device and does not add to the size of the device. Therefore, the hearing aid using the assembly is still inexpensive to manufacture so as to be disposable, yet has a longer life time.

It is to be understood that the apparatus and method of operation taught herein are illustrative of the invention. Modifications may readily be devised by those skilled in the art without departing from the spirit or scope of the invention. While the electronic assembly of the invention has been described in terms of its use in a hearing aid, this assembly, suitably modified, is equally applicable to other devices requiring a battery where its advantages of compactness and volumetric efficiency would be useful. For example, in some applications, the speaker and microphone might not be needed but rather only input and output electrical connections are required. Other electrode-electrolyte systems can be used.

What is claimed is:

1. An assembly comprising:

an enclosed housing;

a cathode within said housing;

an electronic circuit within said housing;

a solution comprising electrolyte and anode material, said solution substantially filling said housing around said circuit; and an electrical contact in said housing forming with said solution, and said cathode, a battery which is connected to and operates said circuit, wherein said battery is an integral part of said assembly.

2. An assembly in accordance with claim 1 in which the solution comprises a zinc anode material, wherein the battery is activated when the cathode is contacted by air, and the housing has a hole therethrough which allows air to enter the housing to contact the cathode.

3. An assembly in accordance with claim 2 in which the electronic circuit comprises a printed circuit board having electronic components thereon and connected together to form a desired circuit.

4. An assembly in accordance with claim 3 including a protective coating over the electronic components to protect the components from the electrolyte.

5. An assembly in accordance with claim 3 further including a speaker and a microphone in said housing and connected to said electronic circuit to form a hearing aid which is operated by the battery.

6. An assembly in accordance with claim 5 in which each of the speaker and microphone extends through the housing.

7. An assembly in accordance with claim 6 further comprising an ear mold surrounding the housing.

8. An assembly in accordance with claim 7 in which the ear mold is of a soft, durable and compliant material.

9. An assembly in accordance with claim 1 in which the housing comprises a tubular sleeve of an insulating material and a separate end cap of a conductive material, for forming an electrical connection with the circuit secured to at least one end of the sleeve.

10. An assembly in accordance with claim 2 in which the housing comprises a tubular sleeve of an insulating material and having an end cap at each end of the sleeve and the hole in the housing for allowing air to enter the housing is in one of the end caps.

11. A hearing aid comprising:

an enclosed housing having opposite ends;

a speaker in said housing and extending through one end of the housing;

a microphone in said housing and extending through the other end of the housing;

an electronic circuit in said housing connecting the speaker and the microphone; and a cathode in said housing;

a solution comprising electrolyte and anode material, said solution filling said housing around said electronic circuit and, with said housing, forming a battery for operating the electronic circuit, wherein said battery is an integral part of said hearing aid.

12. A hearing aid in accordance with claim 11 in which the solution comprises a zinc anode material, wherein the battery is activated when the cathode is exposed to air and the housing has a hole therethrough which allows air to enter the housing.

13. A hearing aid in accordance with claim 12 in which the electronic circuit comprises a printed circuit board having the speaker, microphone and electronic components of the electronic circuit thereon and connected together in a desired circuit.

14. A hearing aid in accordance with claim 13 including a protective coating over the electronic components on the printed circuit board to protect them from the electrolyte.

15. A hearing aid in accordance with claim 13 including an ear mold surrounding the housing.

16. A hearing aid in accordance with claim 15 in which the ear mold is of a soft, durable and compliant material.

17. A hearing aid in accordance with claim 16 including a plurality of wings extending substantially radially outwardly from the air mold.

18. A hearing aid in accordance with claim 11 in which the housing comprises a tubular sleeve of an insulating material and separate end caps of a conductive material secured to opposite ends of the sleeve.

19. A hearing aid in accordance with claim 18 in which the hole in the housing for allowing air to enter the housing is in one of the end caps.

20. A hearing aid in accordance with claim 18 in which the housing is elliptical in cross-section.

* * * * *